US005791822A

United States Patent [19]

Edmondson et al.

[11] Patent Number: 5,791,822

[45] Date of Patent: Aug. 11, 1998

[54] ROD HANDLING APPARATUS AND METHOD

[75] Inventors: Michael Edmondson, Woonona; Brad Neilson, Gwynneville, both of Australia

[73] Assignee: Cram Australia Pty Ltd., New South Wales, Australia

[21] Appl. No.: 740,264

[22] Filed: Oct. 25, 1996

Related U.S. Application Data

[62] Division of Ser. No. 721,908, Sep. 27, 1996.

[51] Int. Cl.[6] ..... E21D 20/00

[52] U.S. Cl. ..... 405/259.1; 405/303

[58] Field of Search ..... 405/259.1–259.6, 405/250–257, 145; 414/22; 29/809, 810, 812, 813; 227/107, 135

[56] References Cited

U.S. PATENT DOCUMENTS

| | | | |
|---|---|---|---|
| 3,622,039 | 11/1971 | Lindstrom | 29/809 X |
| 3,772,757 | 11/1973 | Goldstein | 29/810 X |
| 3,902,561 | 9/1975 | Friberg et al. | 414/22 |
| 3,913,754 | 10/1975 | Swartz et al. | 414/22 |
| 4,226,559 | 10/1980 | Prebensen | 405/303 |
| 4,229,124 | 10/1980 | Frey et al. | 405/303 |
| 4,473,325 | 9/1984 | Beney et al. | 405/303 |

*Primary Examiner*—Dennis L. Taylor
*Attorney, Agent, or Firm*—Whitham, Curtis & Whitham

[57] ABSTRACT

The present invention relates to a method and apparatus for the handling of rods such as drilling rods, roof bolts, or rib bolts, so that they can be removed directly from a storage cradle near a drill rig or other mining operation machinery.

The invention removes the need to manually load rods into drill rigs or other machinery, by a system of transportation mechanisms made up of straps and/or hydraulic actuators, and gate mechanisms to control the entry and exit of the rods from a storage cradle. Gripping mechanisms are also included to deposit the rods to and from a desired location on the drill rigs or other machinery.

38 Claims, 10 Drawing Sheets

220
250
200
252
13
254
256
260
54
106
98
47
202
204
96
48
47
72
102
44
66
66
50
34
244
242
237
207
206
34
24
32
216
262
272
266
270
282
280
234
236
284
222

ROD HANDLING APPARATUS AND METHOD

This application is a division of U.S. patent application Ser. No. 08/721,908, filed Sep. 27, 1996, priority of which is hereby claimed under 35 U.S.C. §120.

FIELD OF THE INVENTION

The present invention relates to apparatus for the handling of rods. Preferably such apparatus is adapted to work in conjunction with mining, drilling tunnelling, excavation and engineering equipment.

BACKGROUND OF THE INVENTION

In the case of long holes, or in the case of rib or roof bolts, the drilling of bores into the roof, side faces or front face of a mine involves a multistage process. This is because in the confined spaces of a mine, the use of single piece drilling rods, the length of the bore, is generally inconvenient, when drilling long bores. Drilling rods have been developed, so that a standard length of drill rod can be joined to another standard length of drill rod, to create a drill rod the length required of the bore. Drill rods are connected by a male thread which fits into a female thread at the other end of the drill rod.

The carrying of multiple drill rods onto track vehicles is limited also by the space constraints of a mine. Prior art systems have generally required the manual loading of drill rods into the mining drill from receptacles positioned behind the drilling machine. A manual loading process by which drilling rods are loaded into drilling machines is labour intensive, expensive, dangerous, and sometimes results in the accidental dismemberment of handler/operators' fingers and other trauma to the handler/operator. The speed of drilling will also be dependent upon the speed at which the handler/operator can load the drill rod into the drilling machine.

When a drill rod is being installed or loaded into a drilling rig, it must be joined to a mated threaded end of an adjacent drilling rod. When being removed from the drilling machine, the drill train has to 'broken' (a term used to refer to the disconnection of adjacent drilling rods from each other) as many times as the number of individual drill rods which are interconnected.

When drilling machinery is utilised in rib bolting or roof bolting the drilling machine is directed to the side walls or roof of the mine. To strengthen a mine, many roof and rib bolts need to be installed. These roof bolts and rib bolts reinforce the roof and walls of the mine by interconnecting them with more stable subterranean formations behind the surface of the wall or roof. The speed of installation of roof and rib bolts is dependent upon several factors. These factors include the speed at which the drilling occurs; the speed of setting of resin; and the speed of provision of roof bolts and their accessibility to install them into a drilling machine. The installation of roof and rib bolts is a labour intensive process.

SUMMARY OF THE INVENTION

The present invention provides an apparatus for the handling of at least one rod into and out of a storage means, said apparatus including a transportation means to transport said at least one rod from said storage means to a gate means which to receives and holds said at least one rod, said gate means including a holding means and a release means to selectively release said at least one rod from or selectively hold said at least one rod in said gate means, thereby permitting said at least one rod to travel into or out of said storage means.

Preferably cooperating with said gate means is a gripping means which can grip said at least one rod when it is in said gate means.

Preferably said gripping means can grip said at least one rod when it is in a predetermined position outside of said gate means.

Preferably said transportation means includes a strap to underlay said at least one rod in said storage means, said strap being adapted to move so as to transport said at least one rod in to said gate means.

Preferably said straps are wound on to a spool to transport said at least one rod in said storage means.

Preferably said gripping means is mounted on an arm.

Preferably said arms guide said at least one rod to an opening in said storage unit from which said at least one rod can be removed, said opening being temporarily occluded by said gate means.

Preferably said arm or a part of said arm forms a part of said opening with said storage means.

Preferably said apparatus is adapted to be mounted together with another device, to work in conjunction therewith, to load and unload said at least one rod onto and from said device.

Preferably said transportation means cooperates with a rod translation means so as to deliver one of said at least one rod to said gate.

Preferably said rod translation means moves said one rod in a generally vertical direction.

Preferably said rod translation means includes a portion to engage said at least one rod to move said at least one rod upon the actuation of an actuator.

Preferably said arm includes an adjustment mechanism so that the angle of the arm relative to said apparatus can be varied if desired.

Preferably said adjustment mechanism includes a screw mechanism which effectively rotates said arm relative to said apparatus.

Preferably said arm is connected to said apparatus by at least one shear bolt.

Preferably said gate means is biased to close said gate.

Preferably said another device is an operational unit which will utilise said at least one rod in a mining operation.

Preferably the gripping means is adapted to position said at least one rod onto a predetermined line of said operational unit.

Preferably said arm is extendable.

Preferably said gripping means includes a handling member to hold said at least one rod.

Preferably said handling member rotates to cradle said at least one rod.

Preferably said transportation means engages said at least one rod at at least one location.

Preferably said transportation means transports said at least one rod by moving an end of said at least one strap.

Preferably said gripping means is adapted to move said at least one rod from said gate means to said operational unit and from said operational unit to said gate means.

Preferably the apparatus is adapted to longitudinally translate said at least one rod.

Preferably the apparatus is adapted to rotate said at least one rod when in said predetermined line of said operational unit.

Preferably said apparatus achieves rotation or longitudinal translation of said at least one rod by means of a roller means included on the arm.

Preferably said operational unit is a drive unit.

Preferably said drive unit is a rotary drive unit.

Preferable said drive unit is a drilling rig.

Preferably said apparatus delivers or removes said at least one rod from a centre line or an axis of rotation of said operational unit or said drive unit.

Preferably the apparatus is rotatable about a substantially horizontal axis to perform mine roof and wall operations.

Preferably said axis is substantially perpendicular to the axis of rotation of said drive unit.

Preferably the apparatus is rotatable about a substantially vertical axis to perform mine roof and wall operations at angles other than perpendicular to mine rod or wall surface.

Preferably said apparatus is adapted to function at an orientation in a range from the horizontal plane to 45°. Preferably said apparatus is adapted to function at an orientation in a range from the vertical axis to 45°.

Preferably said apparatus is adapted to move relative to said drive unit in a direction substantially parallel to the axis of rotation of said drive unit.

Preferably said drilling rig is adapted for gas drainage drilling or rib bolting or roof bolting or a combination thereof.

Preferably said at least one rod is either at least one drill rod, at least on mine roof bolt or at least one mine rib bolt.

The invention also provides a method of handling and transferring a rod from a storage means to outside thereof, said method including the steps of:

(a) moving said rod from a storage area to a gate mechanism co-operating with said storage area;

(b) holding said rod in said gate mechanism;

(c) preventing said rod from exiting said gate mechanism, either out of said storage means or back into said storage means;

(d) holding said rod by a holding means while in said gate means, so as to transfer said rod out of said gate mechanism.

Preferably step (a) is performed by the movement of a strap.

Preferably step (b) is performed by the movement of a linear actuator.

Preferably step (a) is performed by a combination of movement of a strap and a movement of a linear actuator.

Preferably step (b) is performed by a latch means associated with said gate mechanism.

Preferably step (c) is performed by said latch means preventing movement out of said gate mechanism and out of said storage means and an angled support surface to support said rod when in said gate mechanism preventing movement of said rod out of said gate mechanism and into said storage means.

Preferably step (c) wherein one latch means is provided to prevent movement of said rod into said storage means and a second latch means prevents movement of said rod out of said storage means.

Preferably step (d) is performed by said holding means cradling said rod.

Preferably said transfer of said rod out of said storage means of step (d), is performed by means of telescoping or extending arms, moving said rod in a straight line.

Preferably there is added a step (e) which includes placing said rod onto an operational vehicle adjacent the storage means.

Preferably there is added a step (e) which includes effectively simultaneously rotating said rod around and translating said rod along its longitudinal axis after it is held by said holding means The embodiments of the present invention can result in several advantages which include the removal of the need for manual loading and unloading; decreased times for loading and unloading into the drilling; increased productivity levels as the storage unit can store and handle enough rods for most tasks.

BRIEF DESCRIPTION OF THE DRAWINGS

An embodiment of the present invention will now be described by way of example only with reference to the accompanying figures in which.

DETAILED DESCRIPTION OF THE EMBODIMENTS

Figure 1:
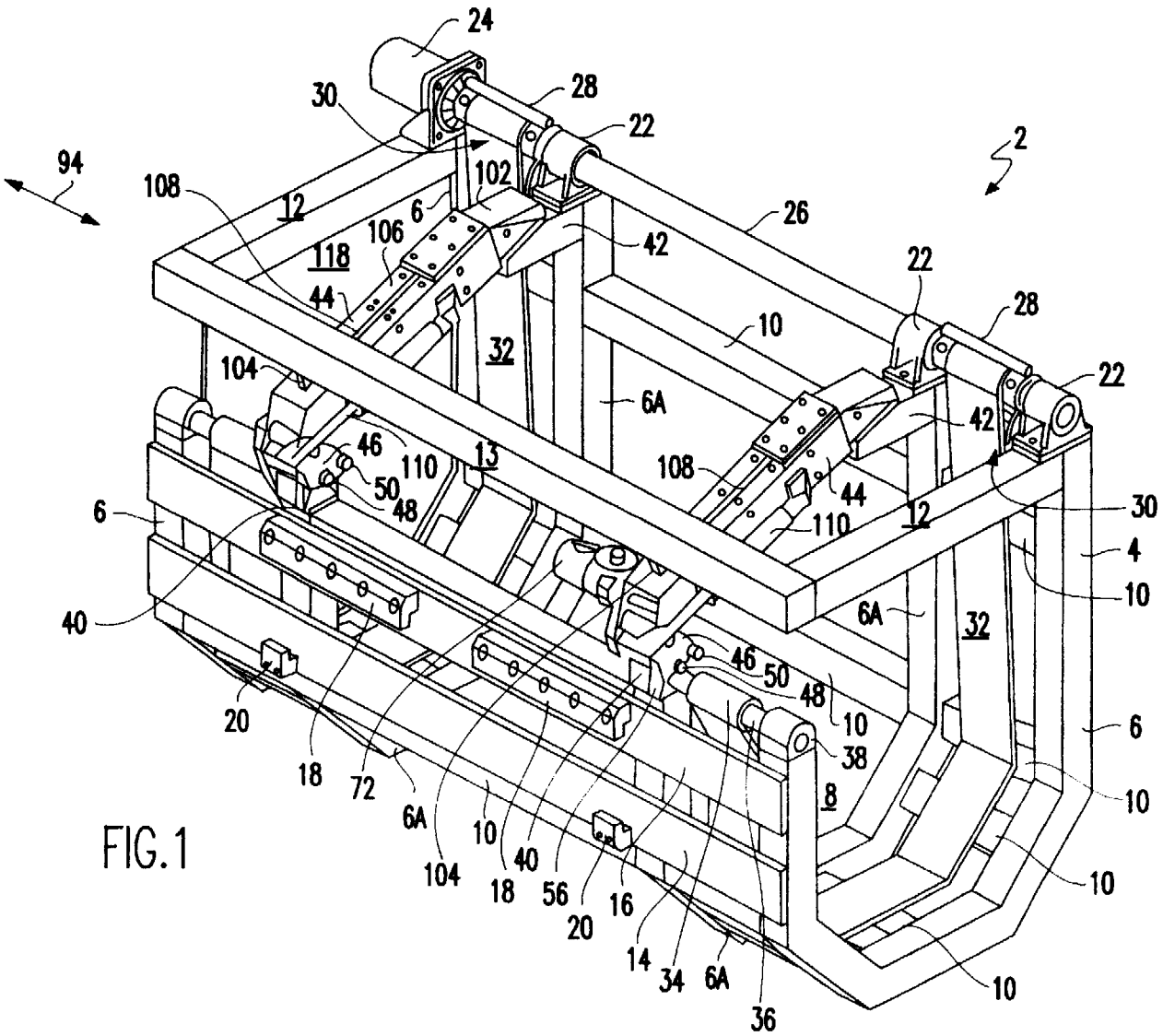
FIG. 1 is a perspective view of an apparatus embodying the present invention.
Figure 5:
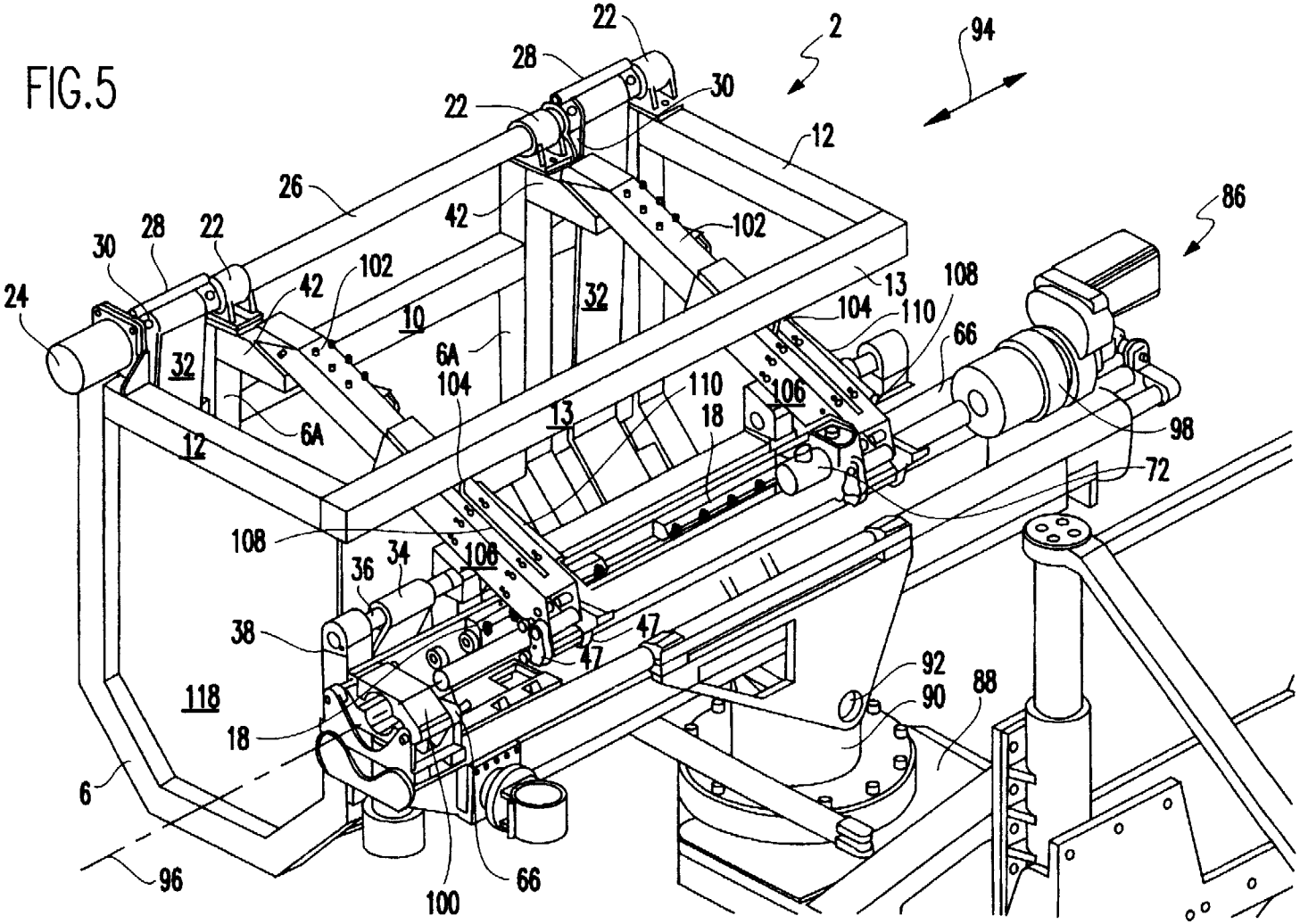
FIG. 5 illustrates the apparatus of FIG. 1 in position on a drilling rig.

Illustrated in FIGS. 1 and 5 is a rod handling apparatus 2 which includes a frame 4. The frame 4 is made up of substantially C, U or J shaped outer members 6 at the both ends and two similarly shaped inner members 6A, which form a cradle space 8.

The cradle space 8 has a generally rectangular prism shape and has at its upper end a slot type opening across the width of the frame 4. The slot type opening is partially occluded by a gate mechanism 56 and an under surface of arm 44. When the gate mechanism 56 is closed no drilling rods held in the cradle space 8, will be able to pass through the slot type opening until the gate mechanism 56 is closed. By positioning the slot type opening at the upper end of the cradle space 8 and thus the rod handling apparatus 2, the drilling rods handled without the need to lift them once they have exited the cradle space 8.

The outer and inner members 6 and 6A are interlinked by lateral frame members 10 which are positioned longitudinally.

Connected to each of the outer members 6 is one end of each of lateral overhead members 12.

The lateral overhead members 12 are also connected together at their other ends to a longitudinal overhead member 13, which supports the arms 44, as will be described below.

On one side of the rod handling apparatus 2 is a bottom wear plate 14 and a top wear plate 16 which rest against a wear plate (not illustrated) on the side of a drilling rig 86 (see FIG. 5) to which the rod handling apparatus 2 connects. On the top wear plate 16 are two upper mounting hooks 18 which hook over a wear plate or mounting rail (not illustrated) on the side of a drilling rig 86. The mounting hooks 18 are of a sufficient length and structural integrity to carry, in a cantilever fashion, the weight of the rod handling apparatus 2, from the wear plate on the drill rig 86. On the bottom wear plate 14 are two lower mounting hooks 20 which engage a lower wear plate or rail on the drill rig 86. The main purpose of the lower mounting hooks 20 is to prevent the bottom wear plate 14 and thus the rod handling apparatus 2, from pivoting around the upper mounting hooks 18. It will also be noted that the upper and lower mounting hooks 18 and 20 allow relative sliding movement on the wear plates or rails of the drill rig 86.

On the highest point of the right hand outer member 6 and on each of the inner shaped members 6A are located three rotational bushes 22. On the left hand outer member 6 of the rod handling apparatus 2 is mounted a hydraulic motor 24 which is linked to and rotates a spool rod 26. The spool rod 26 is rotatably supported by the rotational bushes 22. At either end of the spool rod 26 there are positioned offset bars 28.

Adjacent each of the offset bars 28 is a looped end 30 of a strap 32 which is positioned around the spool rod 26. The looped end 30 is formed by stitching the terminus of the strap 32 to an another portion of the strap 32. The other end of each of the straps 32 is also formed into a loop 34, which is secured into place by means of a pivoting bars 36. The pivoting bars 36 are held in the end 38 of the outer members 6 and the end 40 of inner members 6A on each side of the rod handling apparatus 2. The pivoting bars 36 allow the loops 34 to rotate about them.

On the other ends of the inner members 6A (adjacent to the rotational bushes 22) are platforms 42 on which are positioned and secured arms 44. The arms 44 are telescopic with the telescopic portion moving relative to the platform 42. The arms 44 are made up of a stationary portion 102 and a telescopic or moveable portion 106. At the other end of the arms 44 are hand mechanisms 46 which are better illustrated in FIG. 2. Hand mechanisms 46 are bifurcated into two fingers 47, on each side of a space 49. The space 49 of each hand mechanism 46 is wide enough to allow the ends 40, and other parts located thereon, to pass between the fingers 47.

Each finger 47 has a base roller 48 and an end roller 50. A pivot 54 rotatably connects the hand mechanism 46 to the arm 44. Adjacent the location where the hand mechanism 46 holds a drilling rod 66, is a recessed roller 52 rotatably mounted on the moveable portion 106 of arm 44.

Figure 2:
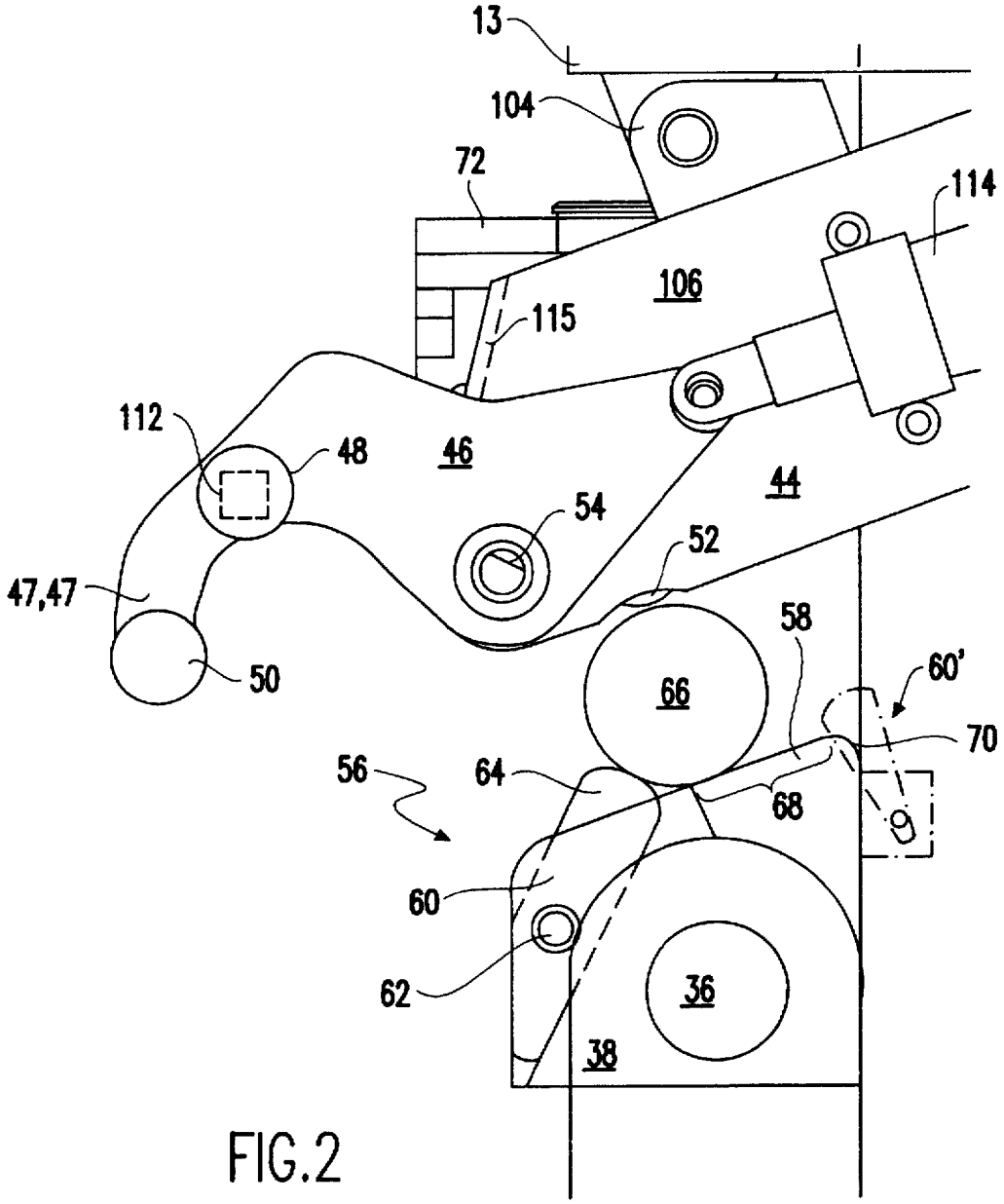
FIG. 2 is a side elevation of the handling mechanism of the apparatus of FIG. 1.
Figure 3:
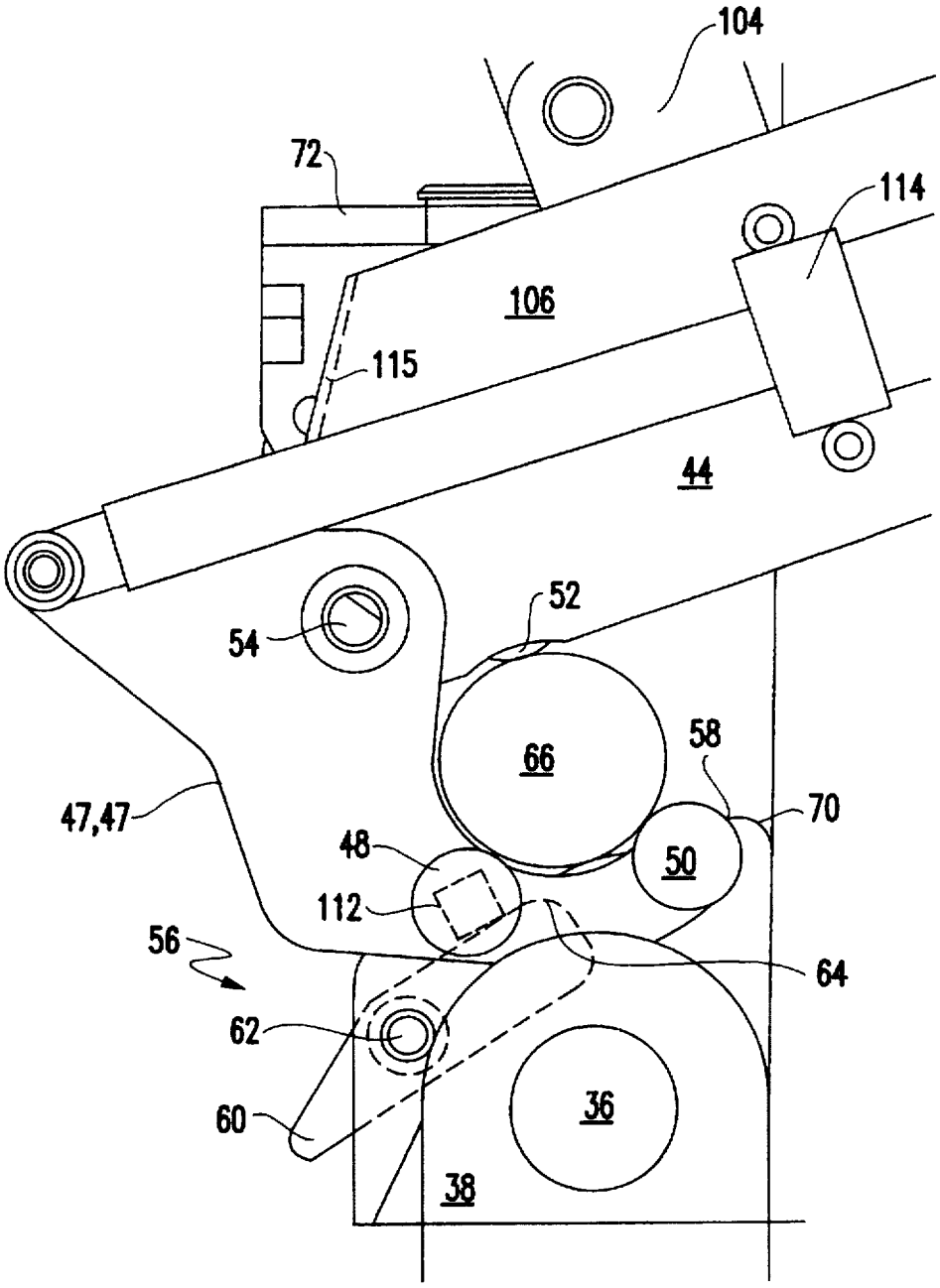
FIG. 3 is similar to FIG. 2 where the handling mechanism is gripping a drill rod.

On each of the inner members 6A, at ends 40, are gate mechanisms 56, one of which is more clearly illustrated in FIGS. 2 and 3. Each gate mechanism 56 has an angled top surface 58 and on a side surface there is pivotally located a latch member 60. The latch member 60 is attached to the gate mechanism 56 by a pivot 62 and biased into the position illustrated in FIG. 2. The bias can be provided by means of a compression, tension or torsion spring or other mechanism. The top portion 64 of latch member 60 projects over the angled top surface and thus obstructs a downward rolling path of a drilling rod 66. The surface area 68 of the angled top surface 58 is of a size sufficient to support only one drilling rod 66. Any drilling rod (not illustrated) to the right of the drilling rod 66 of FIG. 2, would fall over the edge 70 and back into the cradle space 8 of the rod handling apparatus 2.

Figure 4:
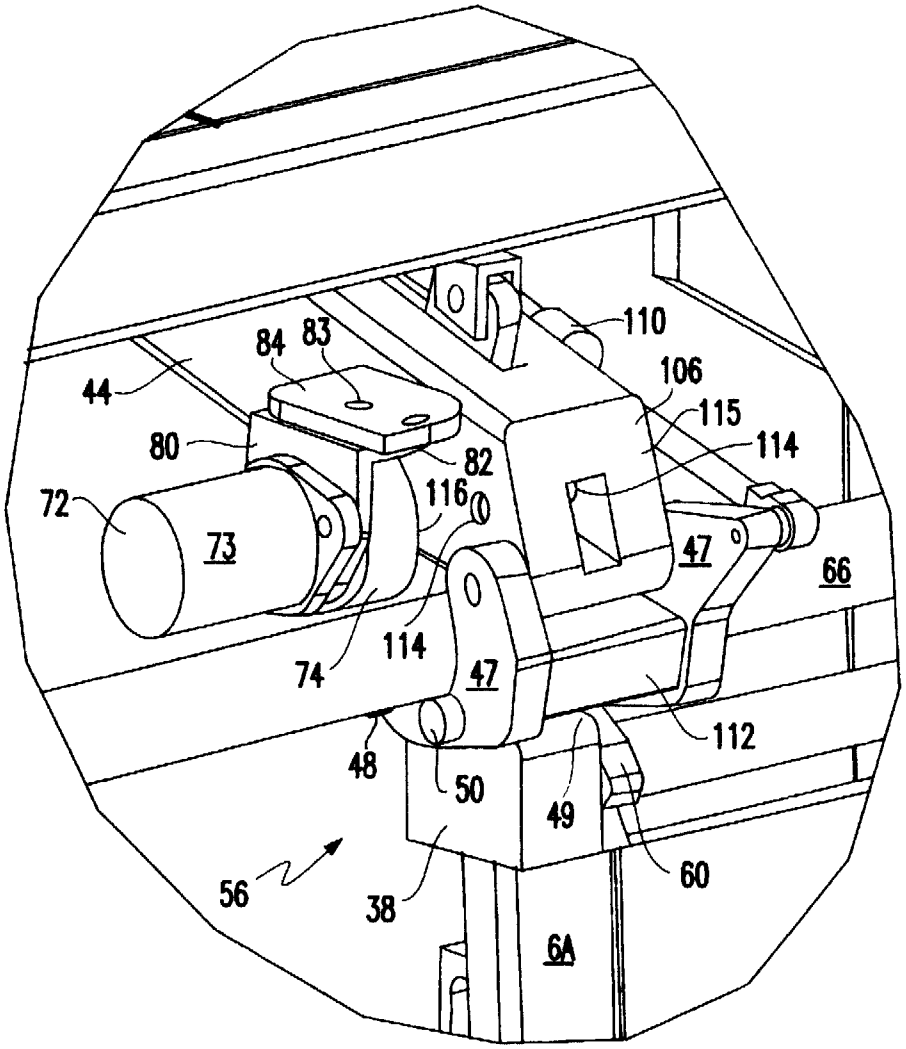
FIG. 4 is a perspective view of the apparatus of FIG. 3 with the drilling rod removed.

Illustrated in FIG. 4 is a rod roller 72, located on the right hand arm 44. The rod roller 72 includes a hydraulic motor 73 which has a rod engaging wheel 74 mounted on a drive spindle of the hydraulic motor 73. The hydraulic motor 73 is clamped to the moveable portion 106 of arm 44 by means of an L-shaped bracket 78. The L-shaped bracket 78 is made up of a leg 80 and another leg 82 which is at substantially 90° to leg 80. The leg 82 engages a bracket 84 which is secured by welding (or other means) to the moveable portion 106 of arm 44. By means of a pivot 83 passing through the bracket 84 and the leg 82 of L shaped bracket 78, the rod roller 72 and rod engaging wheel 74 are able to be rotated about the pivot 83. By being rotated about pivot 83, the rod roller 72 can be positioned so that the rod engaging wheel 74 is at an angle to the longitudinal direction of a drilling rod 66. Preferably the angle is the same as the pitch of the male and female threads of the drilling rods. A securing means (not illustrated) can be used to secure the leg 82 relative to the bracket 84. In FIG. 4, the rod engaging wheel 74 is not yet engaging the surface of the drilling rod 66, because the fingers 47 have not completed their rotation to completely cradle the drilling rod 66. The operation of the rod roller 72 will be discussed below as part of how the rod handling apparatus 2 operates.

Referring to FIGS. 2 and 3, on a side surface of the arm 44 and attached between the moveable portion 106 and the hand mechanism 46, is an hydraulic actuator 110, which when extended, will rotate the hand mechanism 46 anticlockwise, relative to the moveable portion 106. When retracted, the hydraulic actuator 110 will rotate the hand mechanism 46 clockwise.

Illustrated in FIG. 5 is the rod handling apparatus 2 of FIG. 1 assembled together with a drilling rig 86. In this instance the drilling rig 86 is mounted on a support frame 88 atop of pivot 90. The drilling rig 86 is also connected to the pivot 90 by means of axle 92 which allows the tilting of the drilling rig 86 relative to the horizontal plane.

Not illustrated in FIGS. 1 or 5 is a hydraulic actuator which is connected at one end to the rod handling apparatus 2 and at the other to the drilling rig 86. This hydraulic actuator (not illustrated) permits the relative movement in the direction of arrows 94, of the rod handling apparatus 2 relative to the drilling rig 86, when the rod handling apparatus 2 is slideably mounted by the mounting hooks 18 and 20 onto the mounting rails (not illustrated) of the drilling rig 86.

In FIG. 5 the arms 44 are shown in their extended position. In figure S the hand mechanisms 46 are holding a drilling rod 66 and is in the stage of positioning the drilling rod 66 in or on the centre line 96 of rotation of powerhead 98 of the drilling rig 86. When loading a drilling rod 66 into the drilling rig 86, the power head 98 is in the fully retracted position as illustrated in FIG. 5. The drilling rod holder 100 is used to clamp a previously loaded drilling rod to which drilling rod 66 is to be attached. The drilling rig 86 joins adjacent drill rods after the first threads have been started, and breaks them as well. More will be discussed about this below.

The arms 44 each have a stationary portion 102 which is supported at the platform 42 and below the lateral overhead member 12, by anchors 104. It can be seen from FIGS. 1 and 5 that the moveable portion 106 of the arm 44 has a slot 108 to permit the movement of the moveable portion 106 relative to the anchor 104. The stationary portion 102 and moveable portions 106 are made from suitably sized rectangular hollow section. However, between the exterior surfaces of stationary portion 102 and interior surfaces of moveable portion 106 are located bearing surfaces, preferably of steel, (not illustrated) which are meant to wear out and thus not damage the structural integrity of the moveable portion 106 and stationary portion 102.

The ends of an internally positioned hydraulic actuator 114 are connected to the stationary portion 102 and the moveable portion 106. The internally positioned hydraulic actuator 114 (of which only a minute portion can be seen in FIG. 4) is positioned inside the arms 44 behind the cover plate 115 (not illustrated in FIGS. 1 and 5).

Operation of the rod handling apparatus 2 is as follows.

Inside the cradle space 8 are positioned a number (not illustrated) of drilling rods 66. The drilling rods 66 can be any size such as a 66 mm outside diameter drilling rods. The size of the rods 66 will determine dimensional proportions of such things as the distance between rollers 48 and 50; size of latch member 60 etc.

The drilling rods are of sufficient length to sit across each of the straps 32 on the left and right hand side of the rod handling apparatus 2. The width and height of the rod handling apparatus 2 can be made according to the number of drilling rods of a particular size that is wished to be carry. The length of the rod handling apparatus 2 is chosen depending on the length of the drilling rod 66 that is chosen to be carried. In a configuration for 66 mm outside diameter rods, it is preferred that the capacity of the cradle space 8 is such that it can carry and handle from 100 to 120 drilling rods.

When it is required to move a drilling rod 66 out of the cradle space 8 of rod handling apparatus 2 and load it into the drilling rig 86, the hydraulic motor 24 rotates the spool rod 26 until such time as the offset bars 28 engage the looped ends 30 of the straps 32. The continuing rotation of the spool rod 26 (by the hydraulic motor 24) will wind the strap 32 onto the spool rod 26 and around the offset bars 28. This will force drill rods 66 to flow out of the cradle space 8 and into the gate mechanism 56. As illustrated in FIG. 2 and 3, only one drilling rod 66 can engage the gate mechanism 56 because, the underneath surface of arms 44 allow only one drill rod at a time to exit the cradle space 8. This is because the underneath surface of arms 44 together with the surface 58 and latch 60 form the gate mechanism 56, which will only allow one drilling rod 66 at any time to pass through it, once the latch 60 is depressed.

By unwinding the strap 32 from the spool rod 26 either partially or wholly, all the other drill rods in the cradle space 8, except the drilling rod 66 held in the gate mechanism 56, will recede either partially or wholly back into the cradle space 8. This happens because the surface area 68 is dimensioned to accommodate only one drilling rod 66. Thus any drilling rods adjacent to drilling rod 66 when the straps are unwound, will fall back into cradle space 8.

When the drilling rod 66 is positioned in the gate mechanism 56 (as in FIG. 2), rod handling apparatus 2 makes contact at three points with drilling rod 66. Those three points result from contact with the recessed roller 52, top surface 58 and the top portion 64 of latch member 60. A square lug 112 located and extending between the fingers 47 on the hand mechanism 46 engages a surface of the latch member 60.The square lug 112 helps to provide rigidity of one finger 47 relative to the other finger 47 on each hand mechanism 46. If this strength were not required, a stub cylindrical or other type lug could be used, attached to one finger 47 on one side only, to engage the latch member 60. When the hydraulic actuator 110 is extended and the hand mechanism 46 is rotated in an anti-clockwise direction (as illustrated in FIG. 2 and about pivot 54) the lug 112 rotates the latch member 60 so that the latch member 60 is no longer restraining the drilling rod 66. Simultaneously with the latch 60 release action, the base rollers 48 and end rollers 50 move into position under the drilling rod 66 and cradle the drilling rod 66. When the hand mechanism 46 is rotated to its fullest extent, the drilling rod 66 is rotatably secured or cradled between each of the rollers 48, 50 and 52. The release action of the lug 112 pressing against the latch member 60, as in FIG. 3, clears a straight line path, so that the arm 44 when extended can carry the drilling rod 66 in the direction of the longitudinal axis of the arm 44.

Once the drilling rod 66 has been cradled between the recessed roller 52, base roller 48 and end rollers 50, and the latch member 60 has been rotated so that it is below the level of the surface 58, the internal hydraulic actuator 114 (one end of which is seen in FIG. 4), is extended so that the moveable portion 106 of arm 44 moves down alone the stationary portion 102, in the direction of the longitudinal axis of the arm 44. The moveable portion 106 extends until such time (or preset by length of travel and other dimensions) as the centre line of the drilling rod 66 is collinear with the centre line 96 of the drilling rig 86. When in this position (as illustrated in FIG. 5) the rod roller 72 is activated to engage the adjacent threads as will be described below.

Figure 10:
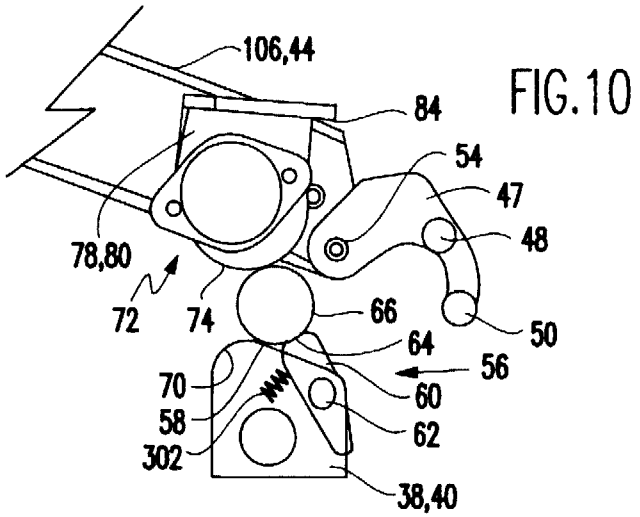

As the moveable portion moves away from gate mechanism 56, the latch 60 moves by the bias of spring 302 (see FIG. 10) to the closed position to prevent any other drilling rods escaping through the gate mechanism.

When the rod handling apparatus 2 is in a generally horizontal orientation, the arrangement and positioning of the rollers 48, 50 and 52 on hand mechanism 46, results in the hand mechanism 46 cradling the drilling rod 66 in rollers 48,50 and 52, with little force or no force exerted on the drilling rod 66 by rollers 48,50 and 52 (other than by the weight of the drilling rod 66 sitting on the rollers 48 and 50). It is the arrangement and positioning of the rollers 48, 50 and 52 to surround the drilling rod 66 which prevent the drilling rod 66 from exiting or falling out of the hand mechanism 46. The little or no force applied allows the drilling rod 66 to move along its own longitudinal axis, in the direction of arrow 94. However, if the rod handling apparatus 2 were in a non horizontal orientation, then it may be necessary to apply a force to the drilling rod 66 by the rollers 48,50 and 52 so as to prevent it from moving, otherwise the moving can be prevented by the engagement and rotation of the rod roller 72, as will be described below. The following description is in respect of the rod handling apparatus in a generally horizontal orientation, but it would be readily understood that the rod roller 72 (when angled to the longitudinal direction of the drilling rod 66) can be used for the purpose of preventing movement of a drilling rod 66 in a vertical direction, when cradled in hand mechanisms 46, if the rod handling apparatus 2 is oriented in a non horizontal orientation.

During initial set-up of the rod handling apparatus 2, the rod roller 72 is rotated so as to be at an angle to the longitudinal axis of the drilling rod 66 and touching a surface thereof, when in position. At such an angle, only the outside surface 116 of the wheel 74 engages the drilling rod 66. Because the outside surface 116 of the rod roller 72 is oriented at an angle to the longitudinal direction of the drilling rod 66, rotation of the wheel 74, and thus outside surface 116 by the hydraulic motor 73 will roll and simultaneously push forward (because of the pitch) the drilling rod 66 so that the tapered male thread engages the female thread of a longitudinally adjacent drilling rod (not illustrated). The end of this drilling rod (not illustrated) would be held by the drilling rod holder 100. The rod roller 72 continues to operate so that the male thread on drilling rod 66 begins engaging the female thread on the adjacent drilling rod (not illustrated). Once one or two threads have been engaged the force required to continue the mating of the threads cannot be produced by the rod roller 72 (because the respective threads are tapered) and thus the power head 98 is engaged onto the end of the drilling rod 66. At that time sufficient rotation and force is given to fully engage the male and female threads at the other end.

The angle of the rod roller 72 to the longitudinal axis of the drilling rod 66 is preferably the same as the helix angle or pitch of the male and female threads on the ends of the drilling rods 66. In this way the drilling rod 66 will advance towards a longitudinally adjacent drilling rod (not illustrated) at the same rate as the pitch of the thread. Another way to achieve the simultaneous rotation and translation of a rod so that any one point of the rod has a locus of movement which is helical and the same helix as the thread, is for the angle of the rod roller 72 to be perpendicular to the longitudinal direction of the drilling rod 66, and to simultaneously move the rod handling apparatus, thus producing a helical motion. Whilst this may be more complicated, it can be just as effective.

Once the drilling rod 66 male thread has properly engaged the female thread of a longitudinally adjacent rod, the hydraulic actuator 110 is retracted thereby rotating the hand mechanism 46 in a clockwise direction (in the view as illustrated in FIGS. 2 and 3) and is disengaged from the drilling rod 66. Retraction of the internal hydraulic actuator 114 retracts the moveable portion 106 back over the stationary portion 102 of the arm 44. Once the moveable portions 106 of the arms 44 are fully retracted and clear of the line of the power head 98, the power head 98 begins its drilling rotation, and simultaneously forces the drilling rod 66 down the longitudinal axis of drilling rod 66 to further the drill head (not illustrated) into the rock surface. The mechanism of moving the power head 98 and the other mechanisms are conventional drilling rig mechanisms, and are not described here.

The above loading process is repeated until the desired length of hole has been drilled or alternatively all drilling rods have been utilised.

The unloading procedure is similar to the loading process, however, in the unloading procedure as the power head 98 needs to go to the end near the drilling rod holder 100 of an adjacent drilling rod, so that it can be unloaded. This requires the rod handling apparatus 2 to be moved in the direction of arrow 94 (towards the right) away from the power head 98, to clear it. When the rod handling apparatus 2 and the arms 44 are clear of the power head 98, the arms 44 reach out to their fully extended position by extending the internal hydraulic actuator 114. When the internal hydraulic actuator 114 is fully extended, the hydraulic actuator 110 is then extended, thereby rotating the hand mechanism 46 about pivot 54, to cradle the drilling rod 66 on the centre line 96 of the drilling rig 86 between the base rollers 48 and end rollers 50.

Once the drilling rod 66 is supported, the power head 98 will break the joined drilling rods so that the drilling rod 66 which is now cradled by the arms 44 is separated from the female thread. Further clearance between the drilling rods can be obtained, or the threads disengaged by rotating the rod roller 72 in a reverse direction, to retract even further the drilling rod 66, from the longitudinally adjacent drilling rod (not illustrated). When the threads are sufficiently disengaged, the arms 44 can be retracted and the drilling rod 66 is moved onto the gate mechanism 56 and held on it. This is done by retracting the hydraulic actuator 110 and the hand mechanism 46 rotating in a clockwise direction, to open the gate mechanism 56 by retracting the latch member 60 with retracting lug 112.

The drilling rod 66 remains in this position until another drilling rod 66 is brought from the drilling rig 96 by the same process as above and knocks the previously positioned drilling rod 66 back into the cradle space 8.

In the unloading operation, straps 32 can be wound up onto the spool rod 26 so that the drilling rods 66 fall a reduced distance rather than the full height of the cradle space 8 , if this is desired. If it is not desired the straps 32 can remain fully retracted and no operation of the hydraulic motor 24 need occur. In this situation the drilling rod 66 will drop from the gate mechanism 56 all the way to the unoccupied base level of the cradle space 8.

The rod handling apparatus 2 and corresponding drilling rig 86 is generally designed to operate in horizontal orientation. However, by pivoting the drilling rig 86 on axle 92 of drilling rig 86, the rod handling apparatus 2 can be tilted relative to the horizontal plane some 30° to 45°. Because the rod handling apparatus 2 and drilling rig 86 can also be rotated about the pivot 90, the rod handling apparatus 2 and drilling rig 86 can be used for rib bolting in the horizontal plane and angled rib bolting determined by the geometric limits of the rod handling apparatus 2.

In order to conduct roof bolting (ie. vertically orienting rod handling apparatus 2) an additional selectively operated latch 60' (see FIG. 2) similar to the latch 60, can be located at the rear of the drilling rod 66 (see FIG. 2) is used to prevent drilling rod 66 moving back into the cradle space 8 of rod handling apparatus 2. The latch mechanism 60' may be biased or unbiased depending upon the sophistication of the control system. However if the latch mechanism 60' is biased it may require activation by some independent means, or it can be de-activated when drilling rods are being transferred back into the rod handling apparatus 2.

If the rod handling apparatus 2 is oriented in the vertical direction or non horizontal orientation, drilling rods 66 would or may rest upon plate 118. When the straps 32 were wound on to spool rods 26, the drill rods 66 closest to the cradle opening of the rod handling apparatus 2 will engage the underneath surfaces of the arms 44. As continuing winding of the strap 32 onto spool rod 26 occurs, this can produce movement along the under surface of the arms 44 towards the gate mechanism 56. When one drilling rod 66 is positioned in the gate mechanism 5 the other latch mechanism (not illustrated) on the cradle side of the gate mechanism 56 of FIGS. 2 and 3 together with latch member 60 hold the drilling rod 66 in position with released roller 52, until the base rollers 48 and end rollers 50 have been rotated into place by the rotation of hand mechanism 46. It may be necessary to place the loops 34 of the straps 32 on to the lateral overhead member 12 and pivot them in that location. This may help the very last rod member can be evacuated out of the cradle space 8. Additionally, the angle of the arms 44 relative to the horizontal or vertical can be altered so that movement of the drilling rods along the arms will be towards the gate mechanism 56.

Figure 6:
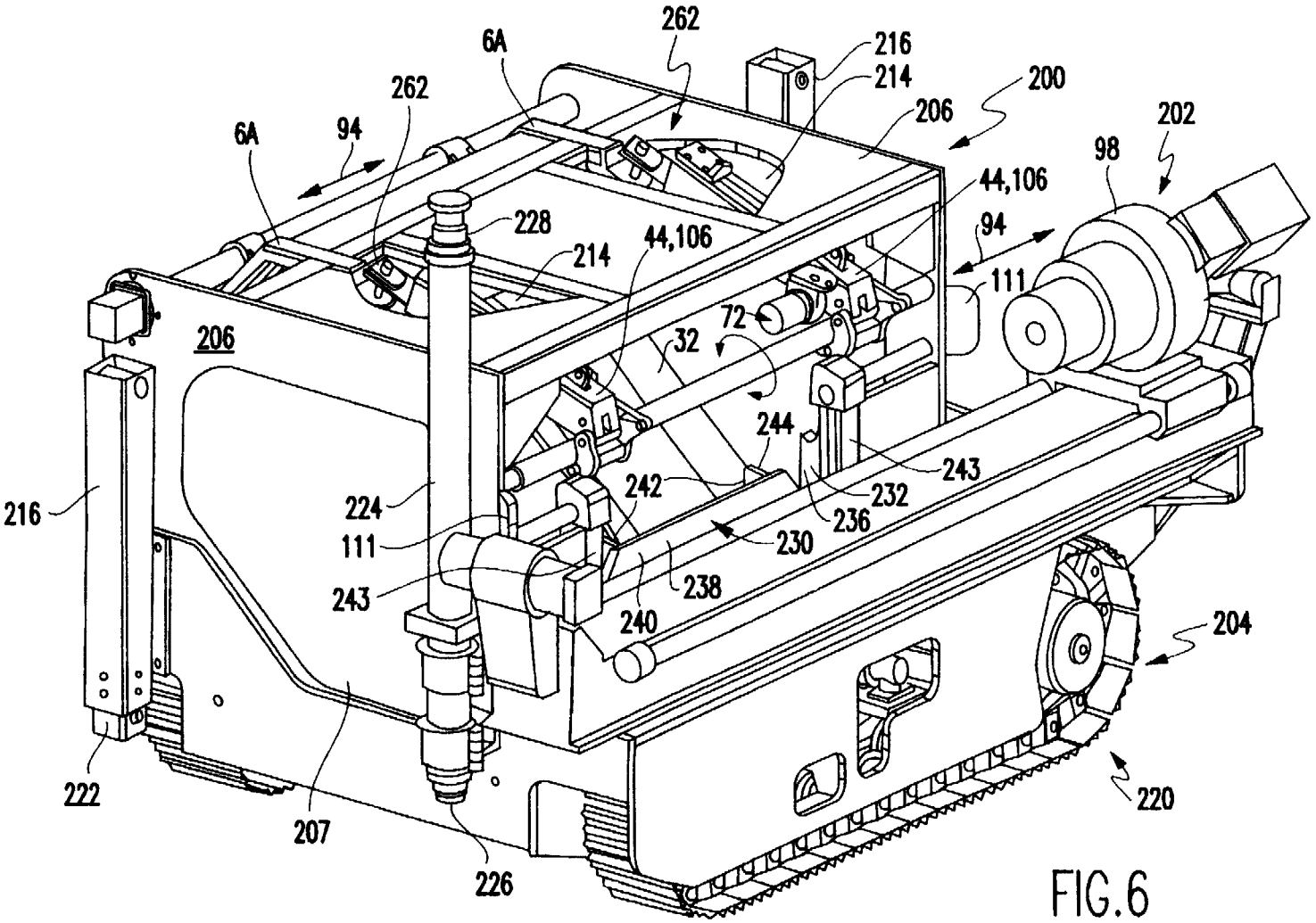
FIG. 6 is a perspective view of a rod handling apparatus assembled with a track vehicle and drill unit.

If desired, when two latches 60 and 60' are utilised the, the surface 58 need not be angled to provide a slope to help retain a drilling rod 66 thereon. The second latch 60' will prevent the drilling rod 66 from rolling back into the cradle space 8. If two latches 60 and 60' are utilised and the surface 58 is perpendicular to side of inside member 6A which terminates in the end 40, then the arms 44 need not be at an angle to the horizontal as they are depicted in FIGS. 1 and 6.

When rod handling apparatus 2 is being used for rib or roof bolting, drilling rods 66 are replaced by rib or roof bolts. Other adjustments to the gate mechanism 56, and the configuration of the hand mechanism 46 will need altering to accommodate different size rods or bolts.

In respect of all the embodiments above, preferably another end plate similar to plate 118 is positioned at the opposite end of the rod handling apparatus 2. This will prevent operators and other staff having fingers caught and trapped as drilling rods and other apparatus which may be included in the cradle space 8 are moving around by strap 32. Such a plate can be hinged to easily allow access to cradle space 8 for the loading of drill rods.

When it is necessary to replenish the rock bolts, or drilling rods in the rod handling apparatus 2, the rod handling apparatus 2 together with the drilling rig 86 mounted on a mobile support can be taken back out of the mine or to an underground storage area, whereby another rod handling apparatus 2 already loaded with drilling rods can be interchanged for the rod handling apparatus 2 which has been emptied. Alternatively, new drilling rods can be simply loaded into the rod handling apparatus 2 already attached to the drilling rig 86.

Whilst the above description relates to embodiments of the invention which are used in conjunction with other equipment, such as drilling rigs, the rod handling apparatus 2 can be simply mounted on a rail vehicle as a dispenser of drill rods or roof and rib bolts, or it can be used to store and dispense other rod like equipment in many other applications which utilise such rod like equipment, such other applications may be engineering, tunnelling or excavation work.

Illustrated in FIG. 6 is a rod handling apparatus 200 which is assembled in combination with a drive or drill unit 202 mounted on a track vehicle 204. For illustration purposes the straps 32 are not depicted in FIG. 6.

The rod handling apparatus 200 functions in a similar manner as that depicted and described in FIGS. 1 to 5, but there are differences, which will be described below. Like parts have been like numbered.

The construction of the rod handling apparatus 200 is different to that of FIGS. 1 to 5 in that the outer members 6 have been replaced by a plate 206 at either end. Each plate 206 has a hatch or door 207 through which access can be gained to the cradle space 8 inside rod handling apparatus 200. The hatch or door 207 can be used to load the rod handling apparatus 200 with rods. To partially protect the contents from falling rock and debris, and to prevent a person accidentally gaining access to the cradle space 8 on the inside of rod handling apparatus 200, three generally horizontal plates 208, 210 and 212 and two generally vertical plates 209 and 211 are positioned and welded (or otherwise secured) to the top and side of the rod handling apparatus 200. The plates 208 and 212 each include an opening 214 to prevent obstruction of the arms 44. The opening 214 also allows access to the arms 44 for adjustment purposes. Attached to the track vehicle 204 are two stab jacks, one stab jack 216 at the front and another stab jack 218 at the rear. When the combined apparatus 220 (made up of rod handling apparatus 200, drive unit 202 and track vehicle 204) are in position and ready to commence operation, the ground engaging member 222 (of which only the one for stab jack 216 is illustrated) can be moved by a hydraulic cylinder inside the stab jack 216 and 218 to engage the ground. The stab jacks 216 and 218 can lift, support and stabilise the weight of the combined apparatus 220, so as to stabilise and adjust the level of the combined apparatus 220.

To further assist in this stabilisation, a stabiliser 224 is also positioned at the front of the track vehicle 204. The stabiliser 224 has a stab jack 226 at one end and a telescopic extension 228 at the other end, so that both the ground and ceiling of a mine can be engaged. This will ensure that all drilling rods will travel in the same direction into a rock/mine wall. When the stabiliser 224 is utilised, the stab jack 226 engages the ground first, and the level of combined apparatus 220 is adjusted together with stab jacks 216 and 218. Once the desired level is achieved, then the telescopic extension 228 engages the ceiling.

Figure 7:
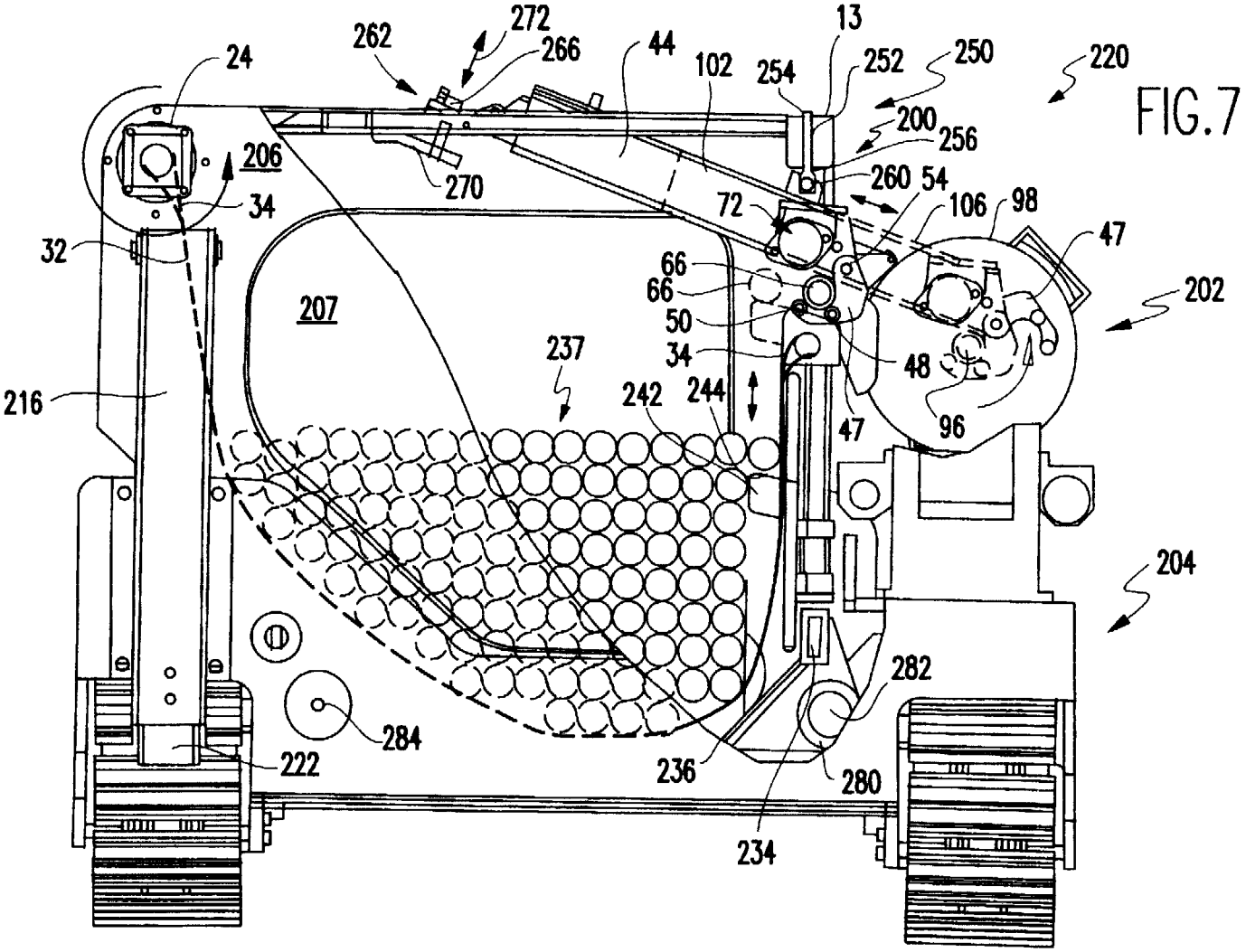
FIG. 7 is a cutaway part cross section and front elevation of the apparatus of FIG. 6.

The rod handling apparatus 200 also includes a rod translation or lifting device 230. The rod translation or lifting device 230 effectively operates as a linear actuator to translate the drilling rod 66. This is more clearly illustrated in FIGS. 7, 8 and 9. In FIG. 7, the cradle space 8 is approximately half full, while in FIG. 8 the cradle space 8 is full. In the embodiment of FIGS. 6 to 9, the cradle space 8 can hold between 250 and 300 drilling rods because the weight of the drilling rods is over the track vehicle 204. Whereas such a number of drilling rods could not be carried by the embodiment of figs i and 5, because the rod handling apparatus 2 is cantilevered, and such a weight will tip the combined apparatus.

The rod lifting device 230 has two stationary cradles 232 which hold a drilling rod such as a drilling rod 66 in FIG. 7. The cradles 232 are formed at the end of a U shaped or RHS members 236, which are adjacent to the pillars 243 to provide a barrier to prevent drilling rods 237 stored in cradle space 8 moving into an area defined for a rod translation or lift mechanism 238 as illustrated in FIG. 7, so as to provide an unobstructed vertical path for the rod translation mechanism 238.

The rod translation mechanism 238 is constructed from a plate 240 which extends between each of the pillars 243. The movement of the plate 240 is guided by guides or wear plates on the facing sides of the members 236. An hydraulic actuator 234 (in FIG. 7) connects to and engages the plate 240 by means of a lug 241, and the frame or structure of the rod handling apparatus 200. The hydraulic actuator 234 operates to move the plate 240 parallel to the pillars 243.

Figure 8:
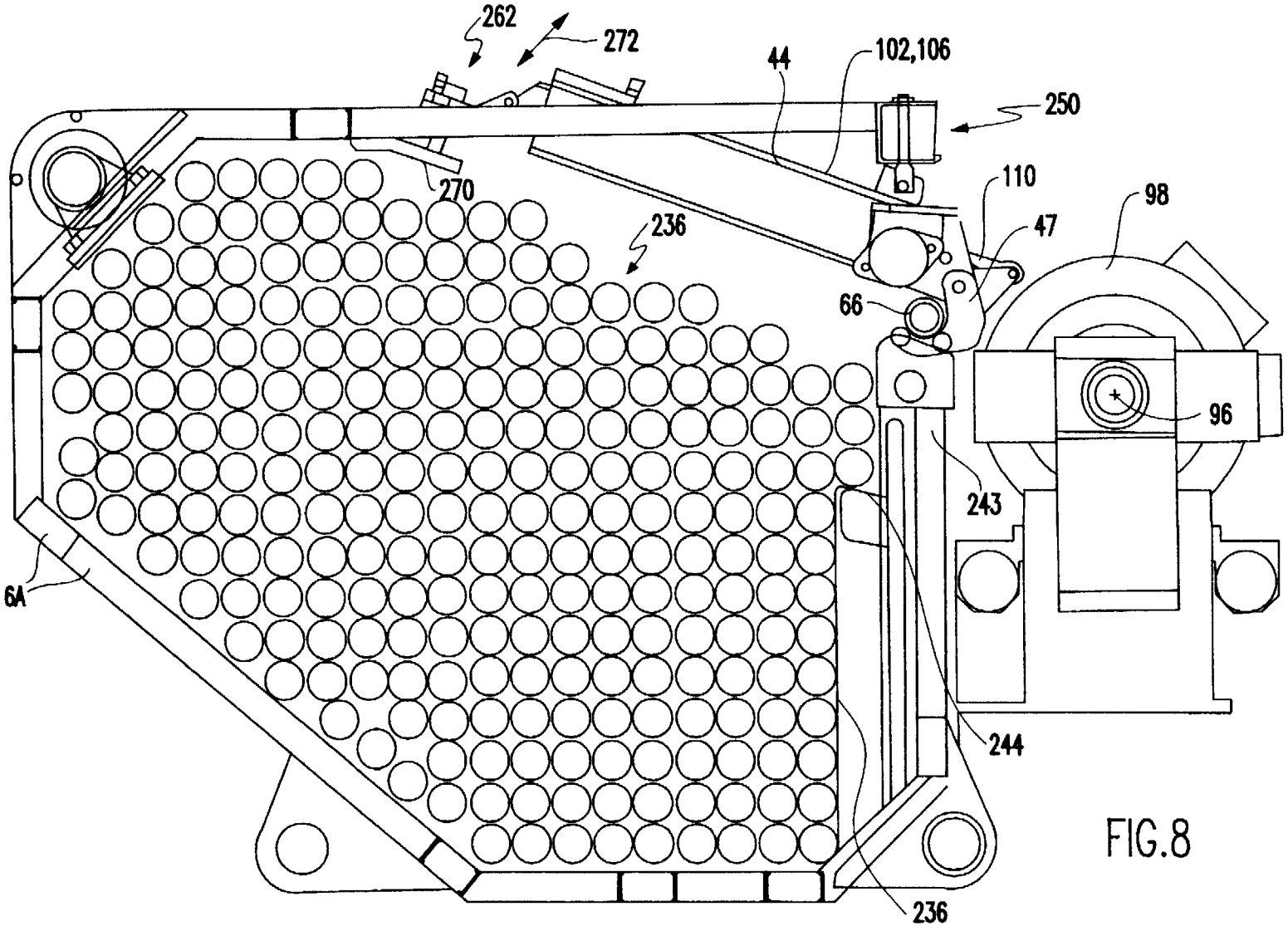
FIG. 8 is a cross section through the rod handling apparatus of FIG. 6.

Near the top of the plate 240 are rod engagers 242 which have angle support surfaces 244 to support a drilling rod 66, as illustrated in FIGS. 7 and 8. The angle of the support surfaces 244 is selected so as to prevent the drilling rod 66 from rolling back into the cradle space 8, and also so that the drilling rod 66 will roll onto the surface 58 and thus into the gate mechanism 56, once the drilling rod 66 is lifted above the barrier to rolling provided by the pillar 243 and the gate mechanisms 56.

The straps 32 and the rod translation mechanism 238 can be used in a variety of ways.

When the storage area is full as in FIG. 8, the straps 32 can be used to deliver a drilling rod 66 into the gate mechanism 56.

In the arrangement illustrated in FIG. 8 the rod translation mechanism 238 can also be used to place a drilling rod 66 into gate mechanism 56. This is because when there is more than one drilling rod 66 above the support surface 244, the rods on top could fall back into the storage area but if one falls in the gate mechanism 56, the rod translation mechanism 238 has been effective.

If one drilling rod 66 falls in the gate mechanism 56, the operator can retract the rod translation mechanism 238. If any of 3 rods, for example as illustrated in FIG. 8, above the rod on the support surface 244 were to fall back into the storage area, the last one will fall into the gate mechanism 56, because of the angle of the support surfaces 244.

However to be more certain a travel guide (not illustrated) could be provided to prevent a rod 66 (which is on top of other rods on the support surface 244) from falling back into the storage area. In this way, as long as the rod translation mechanism 238 can engage drilling rods, it can be utilised to load a rod 66 into gate mechanism 56.

Otherwise, straps 32 can be utilised to load a drilling rod 66 into gate mechanism 56, until the level of the drilling rods is below that of the stationary cradle 232. In this case, the straps 32 can be used to load a single drilling rod 66 into the stationary cradle 232, which is then delivered to the gate mechanism 56 by the rod translation mechanism 238.

Alternatively, an operator can use both the straps 32 and rod translation mechanism 238 in combination so as to ensure that a drilling rod 66 is delivered to the gate mechanism 56 in an efficient manner.

The rod handling apparatus 200, as illustrated in FIG. 7, includes an adjustable anchor 250. The adjustable anchor 250 services a similar purpose to anchor 104 of FIGS. 1 to 5, but because it is adjustable, it can increase or decrease the size of the opening of the gate mechanism 56. In this way different size drilling rods can be received and passed through the gate mechanism 56. The adjustable anchor 250 also allows the size of the opening in the gate mechanism 56 to be fine tuned for a particular size drilling rod to help reduce the chances of a drilling rod jamming in the gate mechanism 56.

The adjustable anchor 250 is constructed from a 10mm bolt 254, the position of which is adjusted by means of a nut 254 on the thread. The bolt 252 has connected to it a yolk 256 which is secured by a pin or bolt 260 to the anchor 250, on arm 44.

The diameter of bolt 252 is selected so that it will readily shear if the drill head 98 of the drive unit 202 were to collide with the arm 44, when the moveable portion 106 of the arm 44 is extended.

Whilst, the ability of the bolt 252 to shear is a safety mechanism to protect the arm 44 and drill head of the drive unit 202, it is only necessary while each of the units making up the combined apparatus 220 are independently operated. It is readily understood that sensors, pawls or stop mechanisms can be incorporated to prevent such collisions of drill head 98 and arms 44.

At the other end of the arms 44 to adjustable anchor 250, is an angle adjustment bolt arrangement 262. The adjustment bolt arrangement 266 allows the arm 44 to be pivoted around adjustable anchor 250, so as to ensure that the hand mechanism 46 delivers a drilling rod 66 onto the centre of rotation 96 of the drill head 98 of drive unit 202.

The adjustment bolt arrangement 266 is made up of a threaded bolt 268 which engages an adjustment plate 270, so that when the bolt 268 is rotated, the arm 44 will move in a direction indicated by arrow 272. Once the desired position is achieved, the bolt 268 is locked in that position by a lock nut or other known lock mechanism.

In the embodiment of FIGS. 1 to 5, the rod handling apparatus 2 could be readily removed from a track or rail vehicle. However, the rod handling apparatus 200 of FIGS. 6 to 9 is designed to be positioned onto a vehicle, such as the track vehicle 204, and only removed for servicing or repair.

Figure 9:
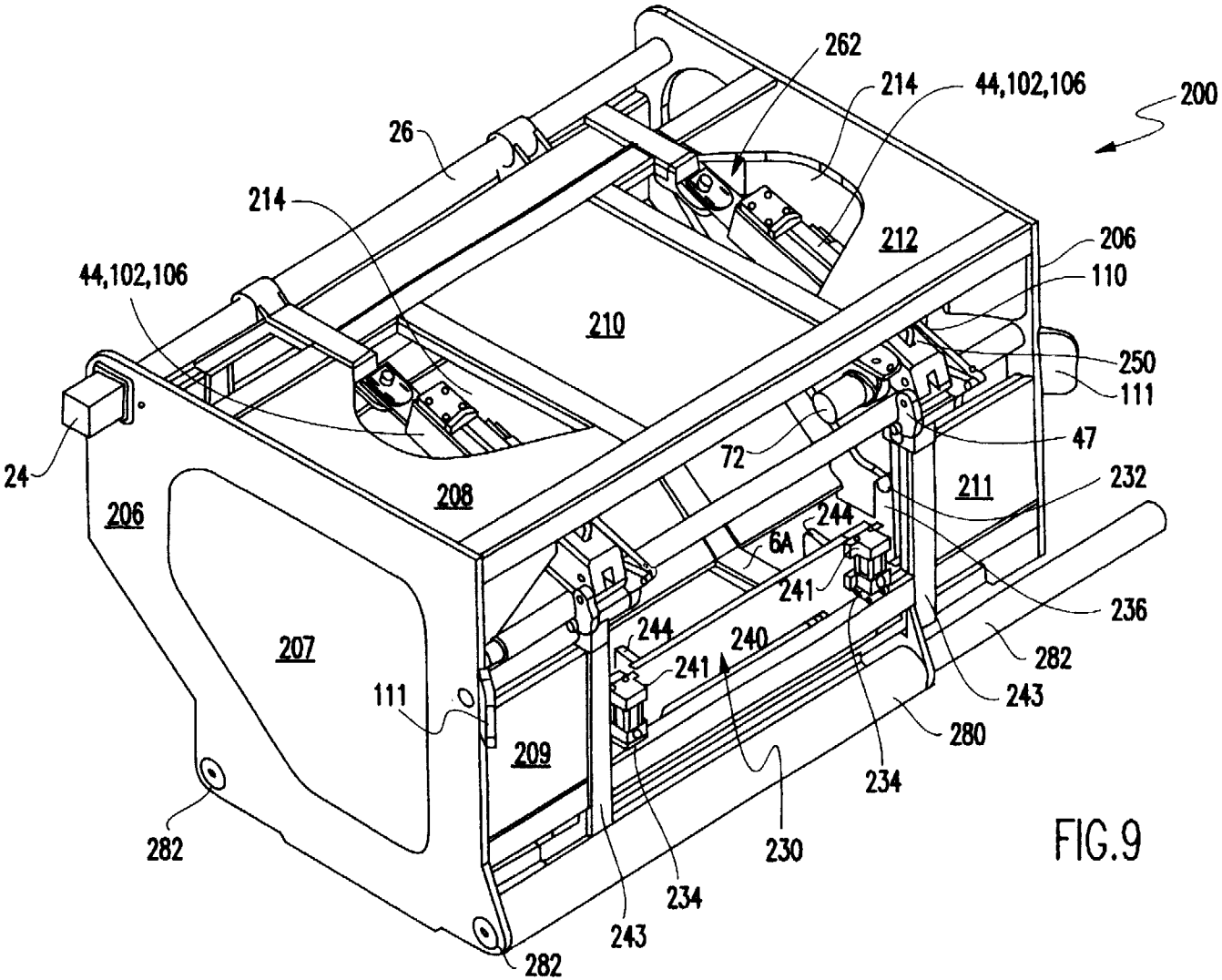
FIG. 9 is a perspective view of the rod handling apparatus, before assembly with a track vehicle and drill unit.

The rod handling apparatus 200 which is illustrated in FIG. 9 (the straps 32 are removed for illustration purposes) has two cylinders 280 attached at its base. When assembling the rod handling apparatus 200 into the track vehicle 204, slide rods 282 are first inserted into the cylinders 280. Then the rod handling apparatus 200, cylinders 280 and rods 282 are secured to the vehicle by means of the slide rods 282 being bolted by bolts 284 to the front and rear of the track vehicle 204. Once in position on the track vehicle 204, an hydraulic actuator (not illustrated) is connected between the rod handling apparatus 200 and the track vehicle 204, so that the rod handling apparatus 200 can slide forward and backward relative to the track vehicle 204 and drive unit 202. This sliding is achieved by the cylinders 280 sliding on rods 282, which are secured to the track vehicle 204. This movement, approximately some 700mm, allows the arms 44 and rod handling apparatus 200 to be positioned in different positions relative to the drill head 98 of drive unit 202, depending on whether drilling rods 66 are being delivered to, or taken from the drive unit 202.

The front 290 and rear 291 of the track vehicle 204 has a cut away portion 292 (not illustrated on rear 291) to accommodate a hatch or door 207 being opened, so that operators can gain access to the cradle space 8 of the rod handling apparatus 200.

Illustrated in FIGS. 10 to 13, are illustrations similar to FIGS. 2 and 3, showing how the rod handling apparatus 200, captures, delivers and deposits drilling rods 66 onto the centre of rotation 96 of a drill unit 202. Like parts have been like numbered and the view of FIGS. 10 to 13 is from the other side view to FIGS. 2 and 3.

Once a drilling rod 66 has been positioned in gate mechanism 56, the drilling rod 66 is held between recessed roller 52, surface 58 and point 64 on latch 60. It will then have adopted the position illustrated in FIG. 10. In this figure the latch 60 has closed the gate mechanism 56, because it is biased to do so.

Figure 11:
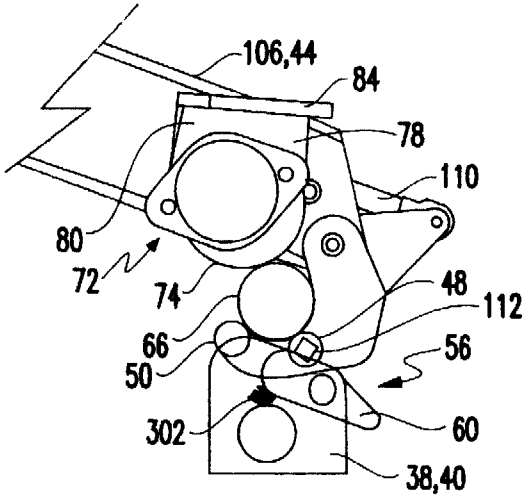
FIGS. 10 to 13 illustrate a sequence of operation of the gripping mechanism and gate mechanism of the rod handling apparatus of FIG. 6.

As illustrated in FIG. 11 when the fingers 47 rotate so that base rollers 48 and end rollers 50 engage the outer surfaces of drilling rod 66, the lug 112 simultaneously depresses the latch member 60 against its bias from a spring 302, thus opening the gate mechanism 56. However, the drilling rod 66 is not able to fall out of the gate mechanism 56, because it is now held between rollers 48, 50 and 52.

Once the components are positioned as in FIG. 11, the moveable portion 106 is extended to position the drilling rod 66 onto the centre of rotation 96 of the power head 98 of the drill unit 202. Simultaneously the latch member 60 (due to its bias to close the gate mechanism 56, which is created by a compression spring 302) moves to re-close the gate mechanism 56. The spring 302 can be of any suitable type, such as tension or torsion or compression. Alternatively, the latch member 60 can be operated by other means or actuators independently of the lug 112.

At this point, the rod roller 72, which has rod engaging wheel 74 already in contact with the drilling rod 66, is activated so that the threads of drilling rod 66 engage the threads of a drilling rod already in the drill unit 202.

Figure 13:
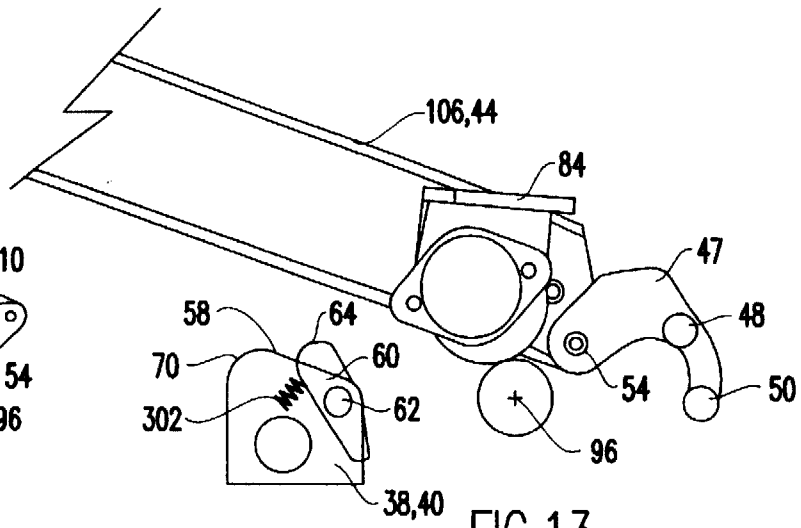
Figure 12:
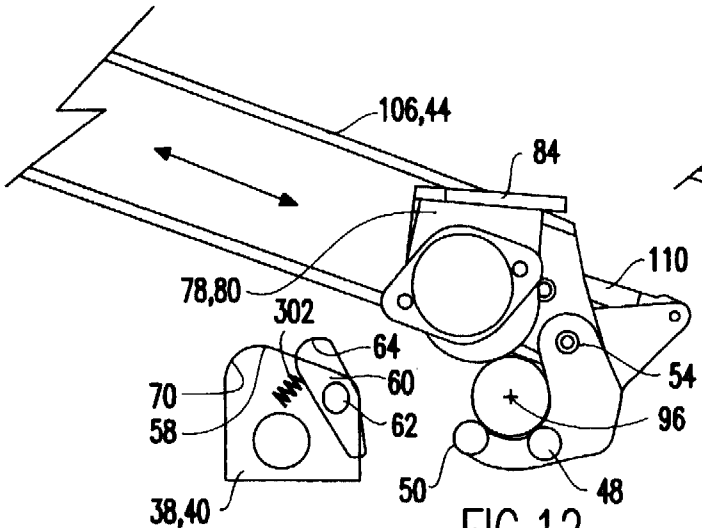

Once the threads of adjacent rods in the drill unit 202 are engaged, then the fingers 47 retract to the position of FIG. 13. The moveable portion 106 can then be full retracted to start the process over.

To remove a rod 66 from the centre of rotation 96 of the power head 98 of the drill unit 202, is the reverse of the above procedure, as has been described with reference to FIGS. 1 to 5.

Illustrated in FIGS. 6 and 9 are two guide plates 111 which are positioned at an angle to the direction of telescoping movement of the arms 44. The plates 111 can help to shift the drilling rod 66 which is held in the hand mechanisms 46, if the end of the drilling rod 66 hits the front surface to the guide plates 111. This may occur if the drilling rod 66 protrudes past the plates 106 when it is taken from the drill rig 202. An alternative mechanism for aligning the drilling rod 66 with the slot type opening of the rod handling apparatus 200, is to utilise the rod roller 72, to move the drilling rod 66 into alignment with the end plates 106. If desired a combination of the rod roller 72 and the guide plates 111 can be used to re align the drilling rod 66 when in the hand mechanisms 46.

The foregoing describes embodiments of the present invention and modifications by those skilled in the art can be made thereto without departing from the scope of the present invention.

We claim:

1. An apparatus for the handling of at least one rod into and out of a storage means, said apparatus including a transportation means to transport said at least one rod from said storage means to a gate means which receives and holds said at least one rod, said gate means including a holding means and release means to selectively release said at least one rod from, or hold said at least one rod, in said gate means, thereby permitting said at least one rod to travel into or out of said storage means.

2. Apparatus as claimed in claim 1 wherein cooperating with said gate means is a gripping means which can grip said at least one rod when it is in said gate means.

3. Apparatus as claimed in claim 2 wherein said gripping means can grip said at least one rod when it is in a predetermined position outside of said gate means.

4. Apparatus as claimed in claim 1 wherein said transportation means includes at least one strap to underlay said at least one rod in said storage means, said strap being adapted to move so as to transport said at least one rod into said gate means.

5. Apparatus as claimed in claim 4 said at least one strap is wound on to a spool to transport said at least one rod in said storage means.

6. Apparatus as claimed in claim 2 wherein said gripping means is mounted on an arm.

7. Apparatus as claimed in claim 6 wherein said arms guide said at least one rod to an opening in said storage unit from which said at least one rod can be removed, said opening being temporarily occluded by said gate means.

8. Apparatus as claimed in claim 6 wherein said arm or a part of said arm, forms a part of said opening with said storage means.

9. Apparatus as claimed in claim 1 wherein said apparatus is adapted to be mounted together with another device, to work in conjunction therewith, to load and unload said at least one rod onto and from said device.

10. Apparatus as claimed in claim 1 wherein said transportation means cooperates with a rod translation means so as to deliver the, or one of the said at least one rod to said gate.

11. Apparatus as claimed in claim 10 wherein said rod translation means moves said one rod in a generally vertical direction.

12. Apparatus as claimed in claim 10 wherein said rod translation means includes a portion to engage said rod to move said rod upon the actuation of an actuator.

13. Apparatus as claimed in claim 6 wherein said arm includes an adjustment mechanism so that the angle of the arm relative to said apparatus can be varied if desired.

14. Apparatus as claimed in claim 13 wherein said adjustment mechanism includes a screw mechanism which effectively rotates said arm relative to said apparatus.

15. Apparatus as claimed in claim 6 wherein said arm is connected to said apparatus by at least one shear bolt.

16. Apparatus as claimed in claim 1 wherein said gate means is biased to close said gate.

17. Apparatus as claimed in claim 9 wherein said another device is an operational unit.

18. Apparatus as claimed in claim 17 wherein the gripping means is adapted to position said at least one rod onto a predetermined position associated with said operational unit, or to retrieve said at least one rod from said predetermined position.

19. Apparatus as claimed in claim 6 wherein said arm is extendable.

20. Apparatus as claimed in claim 2 wherein said gripping means includes a handling member to hold said at least one rod.

21. Apparatus as claimed in claim 20 wherein said handling member rotates to cradle said at least one rod.

22. Apparatus as claimed in claim 1 wherein said transportation means engages said at least one rod at at least one location.

23. Apparatus as claimed in claim 4 wherein said transportation means transports said at least one rod by moving an end of said at least one strap.

24. Apparatus as claimed in claim 1 wherein said gripping means is adapted to move said at least one rod from said gate means to an operational unit and from said operational unit to said gate means.

25. Apparatus as claimed in claim 1 wherein the apparatus is adapted to longitudinally translate said at least one rod.

26. Apparatus as claimed in claim 1 wherein the apparatus is adapted to rotate said at least one rod when in said predetermined line of said operational unit.

27. Apparatus as claimed in claim 1 wherein said apparatus achieves rotation or longitudinal translation of said at least one rod by means of a roller means included on the arm.

28. Apparatus as claimed in claim 9 wherein said operational unit is a drive unit.

29. Apparatus as claimed in claim 28 wherein said drive unit is a drilling rig.

30. Apparatus as claimed in claim 28 wherein said apparatus delivers or removes said at least one rod from a centre line or an axis of rotation of said operational unit or said drive unit.

31. Apparatus as claimed in claim 1 wherein the apparatus is rotatable about a substantially horizontal axis to perform mine roof and wall operations.

32. Apparatus as claimed in claim 31 wherein said axis is substantially perpendicular to the axis of rotation of an associated drill unit.

33. Apparatus as claimed in claim 1 wherein the apparatus is rotatable about a substantially vertical axis to perform mine roof and wall operations at angles other than perpendicular to mine rod or wall surface.

34. Apparatus as claimed in claim 1 wherein said apparatus is adapted to function at an orientation in a range from the horizontal plane to 45°.

35. Apparatus as claimed in claim 1 wherein said apparatus is adapted to function at an orientation in a range from the vertical axis to 45°.

36. Apparatus as claimed in claim 28 wherein said apparatus is adapted to move relative to said drive unit, in a direction substantially parallel to the axis of rotation of said drive unit.

37. Apparatus as claimed in claim 29 wherein said drilling rig is adapted for gas drainage drilling or rib bolting or roof bolting or a combination thereof.

38. Apparatus as claimed in claim 1 wherein said at least one rod is either at least one drill rod, at least on mine roof bolt or at least one mine rib bolt.

* * * * *